US008070252B2

(12) United States Patent
Itoh et al.

(10) Patent No.: US 8,070,252 B2
(45) Date of Patent: Dec. 6, 2011

(54) IMAGE FORMING APPARATUS AND METHOD OF DETECTING CONTAMINATION IN THE IMAGE FORMING APPARATUS

(75) Inventors: Yutaka Itoh, Ebina (JP); Kazuya Tashiro, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 958 days.

(21) Appl. No.: 12/035,897

(22) Filed: Feb. 22, 2008

(65) Prior Publication Data

US 2008/0232832 A1 Sep. 25, 2008

(30) Foreign Application Priority Data

Feb. 28, 2007 (JP) ..... 2007-048667

(51) Int. Cl.
*B41J 29/393* (2006.01)
*B41J 29/38* (2006.01)

(52) U.S. Cl. ..... 347/19; 347/5; 347/16

(58) Field of Classification Search ..... 347/19
See application file for complete search history.

(56) References Cited

FOREIGN PATENT DOCUMENTS

| | | |
|---|---|---|
| JP | 2000-280574 | * 10/2000 |
| JP | 2003-146467 | 5/2003 |
| JP | 2004-351682 | 12/2004 |
| JP | 2005-14426 | 1/2005 |
| JP | 2005-28594 | 2/2005 |
| JP | 2006-248719 | * 9/2006 |
| JP | 2006-346928 | 12/2006 |

* cited by examiner

*Primary Examiner* — Uyen Chau N Le
*Assistant Examiner* — Kajli Prince
(74) *Attorney, Agent, or Firm* — Cooper & Dunham LLP

(57) ABSTRACT

An image forming apparatus includes a transport belt, a carriage, a reflection sensor, and a control unit. The transport belt transports a recording sheet in a sub-scanning direction. The carriage, mounting a recording head, reciprocally moves in a main scanning direction to record an image on the recording sheet. The reflection sensor, mounted on the carriage, receives light reflected from the transport belt to detect a leading edge of the recording sheet, and outputs a detection signal corresponding to the received light. The control unit controls a contamination check process. The control unit instructs the carriage to move to a given position over the transport belt and to drive the transport belt for one rotation while maintaining the carriage at the given position. The control unit determines whether contamination exists on the transport belt based on the detection signal output from the reflection sensor.

14 Claims, 10 Drawing Sheets

MOVE CARRIAGE TO LEADING EDGE DETECTION POSITION
(LEADING EDGE DETECTION POSITION)

MISS DETECTION OF LEADING EDGE

DETECT CONTAMINATION AS LEADING EDGE AND PRINT

IMAGE FORMING APPARATUS AND METHOD OF DETECTING CONTAMINATION IN THE IMAGE FORMING APPARATUS

CROSS-REFERENCE TO RELATED APPLICATIONS

This application claims priority from Japanese Patent Application No. 2007-048667 filed on Feb. 28, 2007 in the Japan Patent Office, the entire contents of which are hereby incorporated by reference herein.

BACKGROUND OF THE INVENTION

1. Field of the Invention

The present disclosure generally relates to an image forming apparatus having a carriage for holding a recording head, which is reciprocally moved in a main scanning direction, and a transport belt for transporting a recording sheet in a sub-scanning direction, in which an image is recorded on the recording sheet by using the recording head.

2. Description of the Background Art

Some image forming apparatuses have a configuration employing a carriage mounting a recording head (e.g., inkjet head), which is reciprocally moved in a main scanning direction, and a transport belt for transporting a recording sheet in a sub-scanning direction to record an image on the recording sheet by using the recording head. In such a configuration, the recording sheet is closely attracted to the transport belt, which is in an electrically charged state.

In such image forming apparatus, the carriage has a reflection sensor to detect a leading edge of a recording sheet. However, if the transport belt is contaminated, a leading edge of a recording sheet may not be correctly detected (i.e., missed detection).

One background art technique to prevent such missed detection employs a method that detects contamination on a transport belt so that sheet position can be correctly detected prior to sheet feed. However, such detection may need to be conducted for each page, thereby degrading overall printing efficiency (or printing productivity) of an image forming apparatus.

SUMMARY

In an aspect of the present disclosure, an image forming apparatus includes a transport belt, a carriage, a reflection sensor, and a control unit. The transport belt transports a recording sheet in a sub-scanning direction. The carriage, mounting a recording head, reciprocally moves in a main scanning direction to record an image on the recording sheet. The reflection sensor, mounted on the carriage, receives light reflected from the transport belt to detect a leading edge of the recording sheet, and the reflection sensor outputs a detection signal corresponding to the received light. The control unit controls a contamination check process. In the contamination check process, when the image forming apparatus is activated and before transporting the recording sheet to the transport belt, the control unit instructs the carriage to move to a given position over the transport belt and to drive the transport belt for one rotation while maintaining the carriage at the given position and determines whether contamination exists on the transport belt based on the detection signal output from the reflection sensor.

In another aspect of the present disclosure, a method of checking for contamination on a transport belt is provided.

The method includes setting, rotating, comparing, and determining. The setting sets a sensor to a given position over the transport belt to detect light reflected from the transport belt. The rotating rotates the transport belt in a given direction for one rotation. The comparing compares an intensity of the light detected by the sensor with a given threshold value. The determining determines a contamination level on the transport belt based on a result of comparing the intensity of the light detected by the sensor with the given threshold value.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
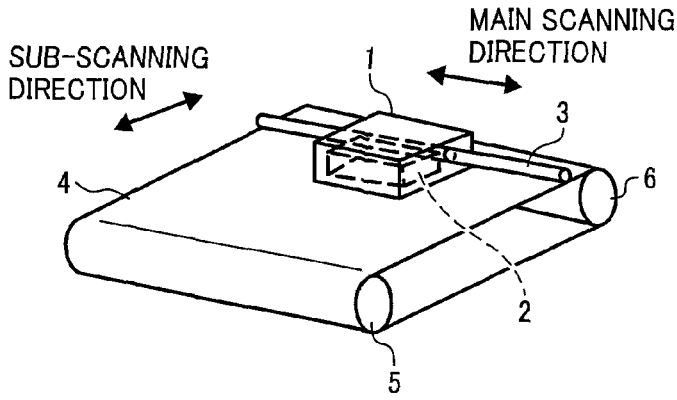
FIG. 1 illustrates a schematic configuration of a recording head unit and a sheet transport unit of an image forming apparatus according to an exemplary embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an exemplary embodiment is described with reference to accompanying drawings. The image forming apparatus may employ electrophotography, for example.

FIG. 1 illustrates a schematic view of a recording head unit and a sheet transport unit of an image forming apparatus according to an exemplary embodiment. In a configuration of FIG. 1, a carriage 1 includes a print head 2 such as inkjet head. The carriage 1, supported by a guide shaft 3, can be reciprocally moved in a main scanning direction by a driving mechanism (not shown). Further, a transport belt 4, extended by a drive roller 5 and a driven roller 6, transports a recording medium (e.g., sheet) in a sub-scanning direction. Because a surface of the transport belt 4 can be charged by a charger (not shown), a recording medium can be transported by the transport belt 4 while closely attracted to the surface of the transport belt 4 with electrostatic force.

Figure 2:
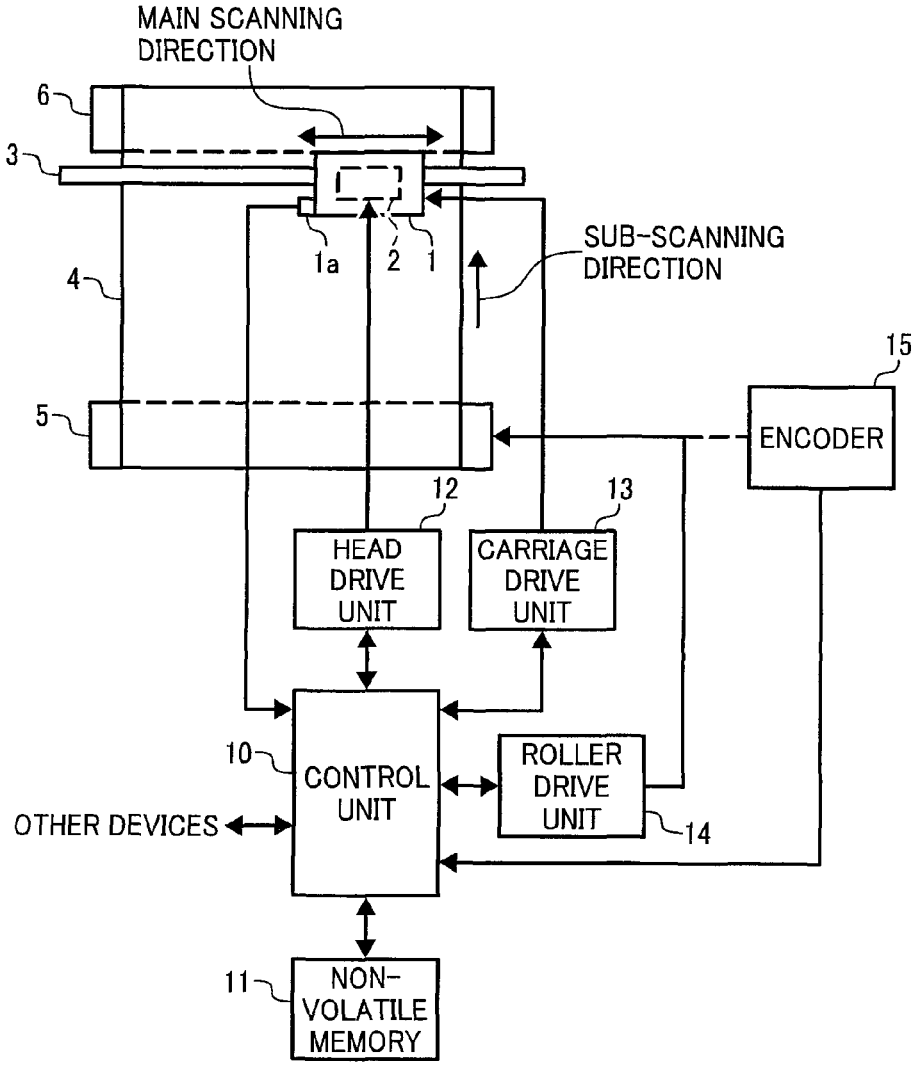
FIG. 2 is a block diagram of a control system for the image forming apparatus of FIG. 1.

FIG. 2 illustrates a control system for the image forming apparatus according to an exemplary embodiment. The control system includes a control unit 10, a non-volatile memory 11, a head drive unit 12, a carriage drive unit 13, a roller drive unit 14, and an encoder 15, for example. The non-volatile memory 11 stores information or data. The head drive unit 12 drives the print head 2 when to print images (e.g., characters). The carriage drive unit 13 drives the carriage 1 reciprocally in a main scanning direction. The roller drive unit 14 drives the drive roller 5. The control unit 10 controls the non-volatile memory 11, the head drive unit 12, the carriage drive unit 13, the roller drive unit 14, or the like as a whole to conduct given operations such as printing, for example. The encoder 15 is used to detect a driving condition (e.g., driving position) of the drive roller 5, and transmits a detection signal corresponding to the driving condition of the drive roller 5 to the control unit 10.

Further, the carriage 1 has a reflection sensor 1*a* (see FIG. 2) at one end of the carriage 1, wherein a light beam, projected to a surface of the transport belt 4 from a light source (not shown), reflects on the transport belt 4, and such reflection light is received by the reflection sensor 1*a*. The reflection sensor 1*a* is used to detect a leading edge of a recording medium (e.g., sheet) transported by the transport belt 4, and also used to detect contamination on the transport belt 4 (to be described later).

Further, the control unit 10 may be used to control several functions using a variety of information or data. Such functions may be a host interface function for data transmission with a host unit, a user interface function for data transmission with a user apparatus, an opening/closing detection function of a housing cover using a cover sensor, a sheet feed function using the transport belt 4, an energy-saving function (e.g., standby mode) of an apparatus, for example.

Figure 3A:
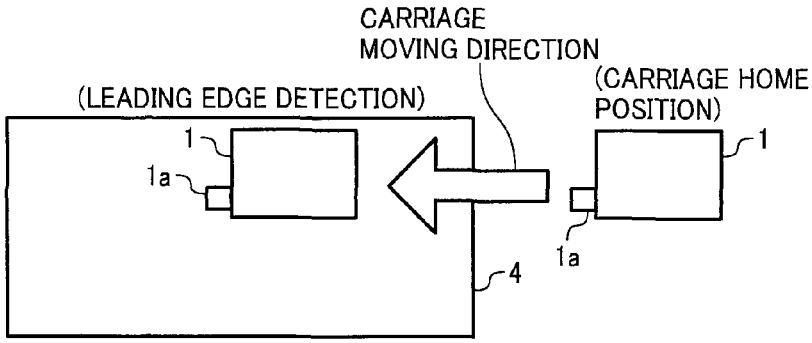
FIGS. 3A to 3B illustrate schematic views for a leading edge detection process of a recording medium.
Figure 3B:
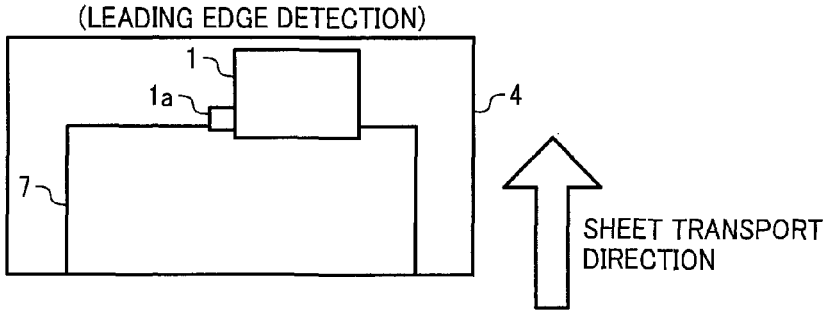

When to start a printing operation, such control system instructs the carriage 1 to move in a main scanning direction to set the reflection sensor 1*a* at a given position in a main scanning direction on the transport belt 4. For example, the reflection sensor 1*a* is positioned at the center in a main scanning direction. When a recording medium 7 (e.g., sheet) is transported by the transport belt 4, a leading edge of the recording medium 7 is detected by the reflection sensor 1*a* as illustrated in FIGS. 3A and 3B.

With such configuration for detecting a leading edge of the recording medium 7, recording ink may not be jetted outside of the recording medium 7 when forming an image on the recording medium 7, by which contamination may not occur on the transport belt 4. Accordingly, the transport belt 4 can be maintained in a clean condition, and thereby the recording medium 7 can be effectively attracted to the transport belt 4, and the flatness of the recording medium 7 attracted on the transport belt 4 can be attained.

Figure 4:
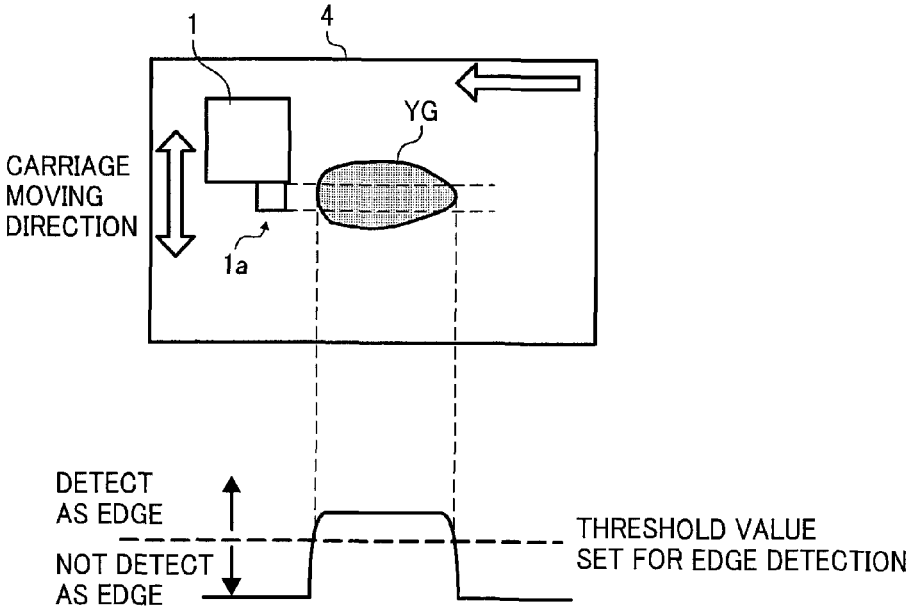
FIG. 4 illustrates a schematic view for a missed detection of a leading edge of a recording medium.

However, as illustrated in FIG. 4, if a contamination YG may exist on the transport belt 4 due to some reasons and if a reflection light intensity received by the reflection sensor 1*a* exceeds a threshold value of "positive detection of recording medium" at such contamination YG position, the control system may mistakenly detect such contamination YG position as a leading edge of the recording medium 7. Such wrong detection may be termed as "missed detection."

Figure 5A:
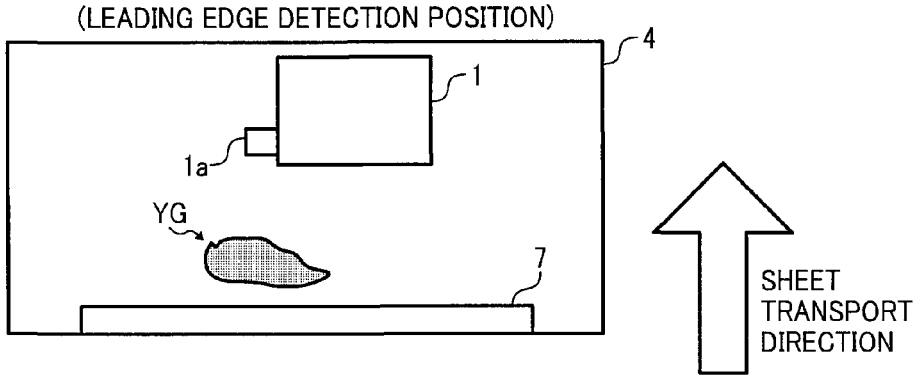
FIGS. 5A to 5C illustrate schematic views for a missed detection of a leading edge of a recording medium and associated problem.
Figure 5B:
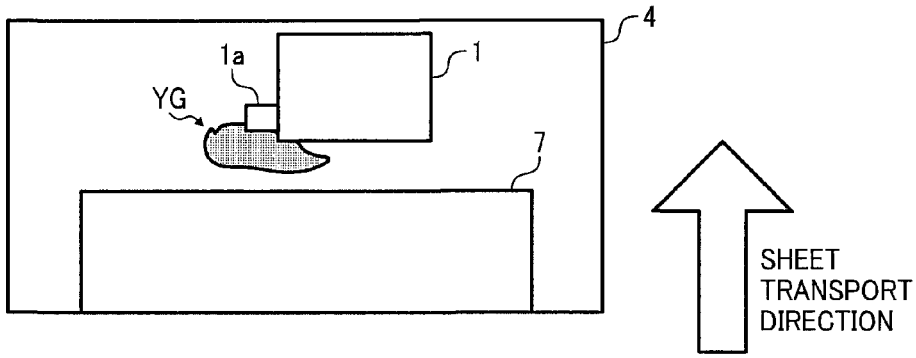
Figure 5C:
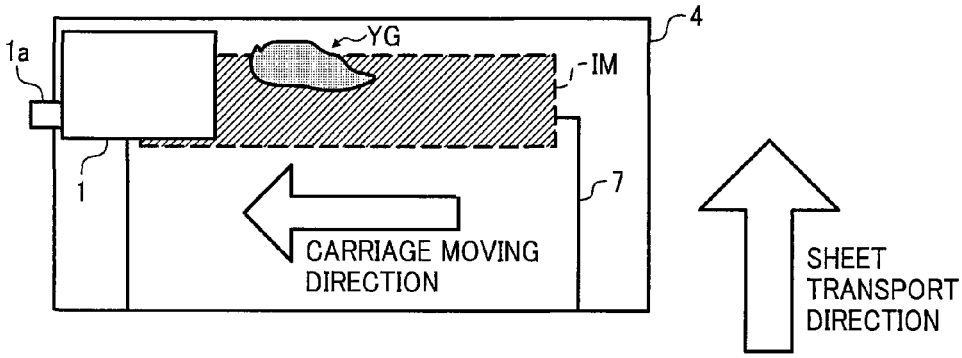

If such missed detection may occur when detecting a leading edge of the recording medium 7, an image position IM on the recording medium 7 may deviate from a correct position, and such condition may cause a contamination (e.g., ink contamination) on the transport belt 4 because ink cannot be jetted on a correct position on the recording medium 7 as shown in FIGS. 5A to 5C. For example, ink may be jetted outside of the recording medium 7 as shown in FIG. 5C.

Figure 7:
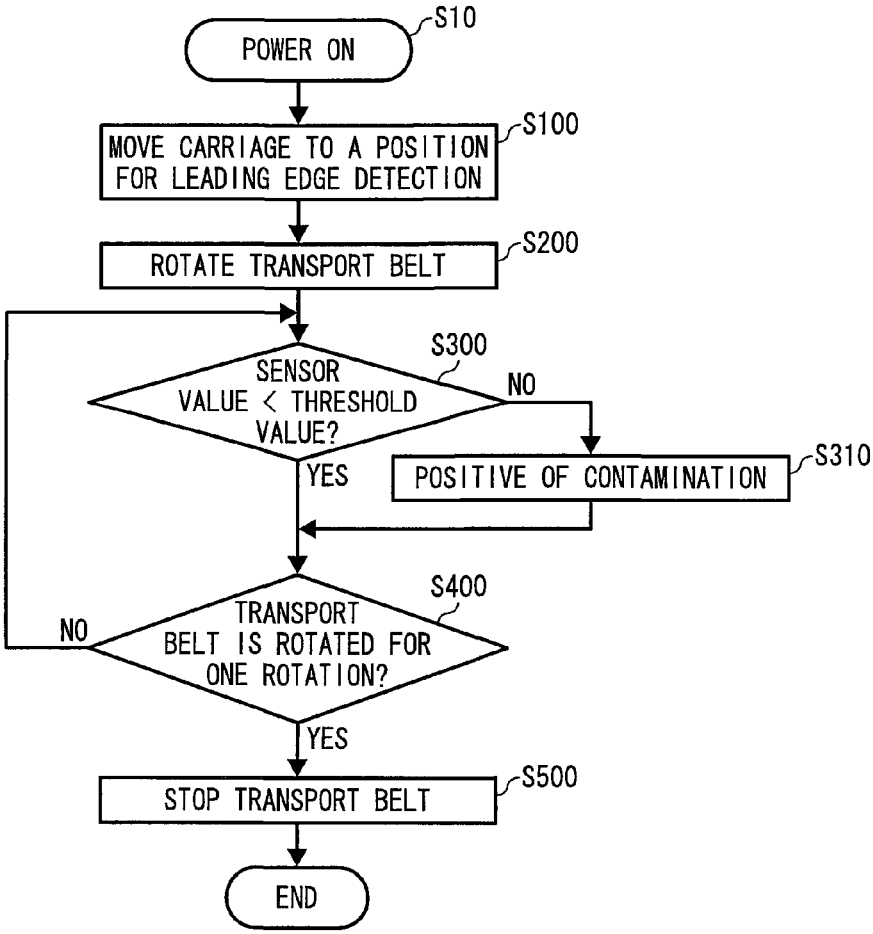
FIG. 7 is a flow chart for a contamination check process according to an exemplary embodiment.

In view of such "missed detection," a description is now given to "contamination check process" according to an exemplary embodiment with reference to FIG. 7 showing an example flow chart for such "contamination check process."

When a power is set to ON for the image forming apparatus at step S10, the carriage 1 is moved in a main scanning direction over the transport belt 4 while setting the reflection sensor 1*a* at a given position in the main scanning direction at step 100. For example, the reflection sensor 1*a* is set to the center of the main scanning direction. Then the transport belt 4 is rotated for one rotation to detect existence or nonexistence of contamination on the transport belt 4 using the reflection sensor 1*a* at step S200.

Figure 6:
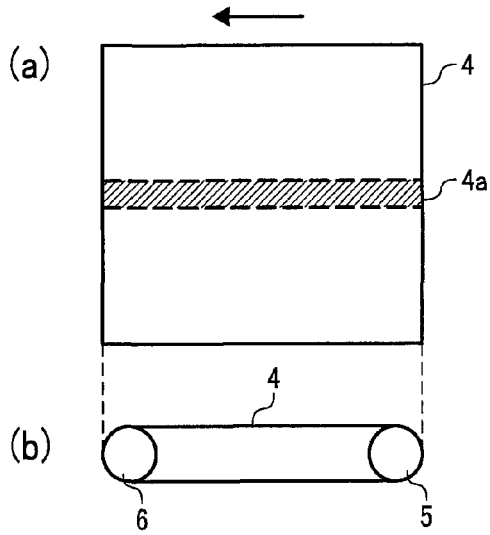
FIG. 6 illustrates a schematic view of a transport belt and a leading edge detection area on the transport belt.

During such "contamination check process," a check area 4*a* (see FIG. 6) set on the transport belt 4 is checked to detect an existence or nonexistence of contamination on the transport belt 4 because such contamination may cause the aforementioned missed detection. As shown in FIG. 7, if the reflection sensor 1*a* detects a sensor value greater than a given threshold value at step S300, the contamination is detected at step S310. Such process is conducted for rotating the transport belt 4 in one direction at step S400, and then the transport belt 4 is stopped. With such "contamination check process," contamination on the transport belt 4 can be checked before conducting a printing operation.

If an image forming apparatus has abnormal condition such as movement malfunction of the carriage 1, driving malfunction of the transport belt 4, or the like when a power is set to ON, such abnormal condition may need to be remedied to start the aforementioned contamination check process.

A description is now given to a case when contamination such as ink contamination occurs on the transport belt 4 due to sheet jamming. For example, contamination may occur on the transport belt 4 when the carriage 1 moves in a main scanning direction for printing images because such moving carriage 1 may cause a sheet jamming of the recording medium 7 (e.g., sheet) if the moving carriage 1 contacts and curls the recording medium 7 over the transport belt 4. Further, contamination may occur on the transport belt 4 when a user removes a jammed sheet.

Accordingly, the image forming apparatus includes a cover sensor for detecting opening/closing of a cover of the image forming apparatus. A user opens the cover to remove a jammed sheet when sheet jamming occurs, and closes the cover after removing the jammed sheet. When the cover sensor detects such closing of the cover, the aforementioned contamination check process for detecting existence or nonexistence of contamination (see FIG. 7) is conducted because such contamination may cause the aforementioned missed detection.

Figure 8:
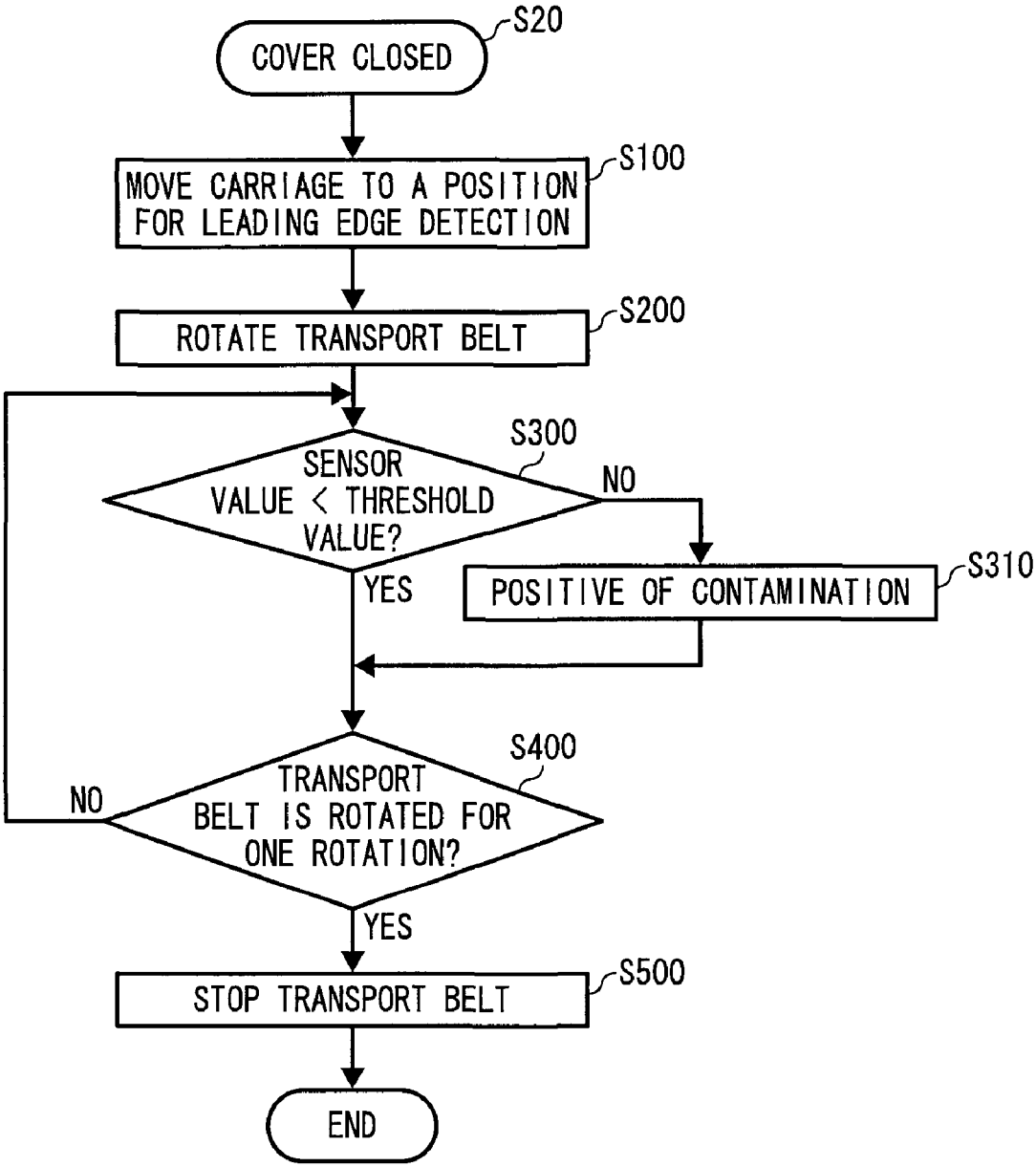
FIGS. 8 to 13 are another flow charts for another contamination check processes according to another exemplary embodiments.

FIG. 8 shows a flow chart for such "contamination check process" including a detection of closing of the cover. FIG. 8 shows the flow chart, which is similar to the flow chart shown in FIG. 7 except that a contamination check process is started when the cover is closed.

A description is now given to a case for recognizing a position of contaminated area, detected by the "contamination check process," in which the control system of the image forming apparatus can recognize such contamination position for a given time period. Such detected position of contaminated area can be stored in the non-volatile memory 11, by which the control system can recognize a present or future position of the detected contaminated area for a given time period.

Because a contaminated area generally has some width, a first edge portion and a second edge portion of the contaminated area may need to be recognized and stored in the non-volatile memory 11. The first and second edge portions of the contaminated area may be opposite portions each other. For example, the first and second edge portions are most distant portions of the contaminated area, and the first edge portion is a contamination starting position and the second edge portion is a contamination ending position. If such contamination data is not stored in a memory or the like, detected contamination cannot be used for a control operation related to image forming or the like.

Because the transport belt 4 is provided with the encoder 15, which is used to measure a transport amount of the recording medium 7 transported by the transport belt 4, the encoder 15 can also be used to measure a traveling distance of the transport belt 4. With such encoder 15, a position of contaminated area on the transport belt 4 can be identified.

For example, while rotating the transport belt 4 for detecting contamination existence or nonexistence, a first edge portion of the contamination, which is detected at first, may be recorded as "start position" or "zero position" of the contamination, and then the second edge portion of the contamination, which is detected at last, may be recorded as "last position" or "end position" of the contamination. With such "start position" and "last position" of the contamination, a relative position of the contamination on the transport belt 4 can be identified. Such "start position" and "last position" of the contamination can be stored in the non-volatile memory 11 as data, and the position of contaminated area can be identified based on the data.

Because the control system can be configured to routinely receive signals from the encoder 15, the control system can compute a present or future position of contaminated area at any given timing using contaminated area data stored in the non-volatile memory 11. For example, based on a present position data of contaminated area, the control system can compute a position of the contaminated area at given time later when the transport belt 4 moves.

Figure 9:
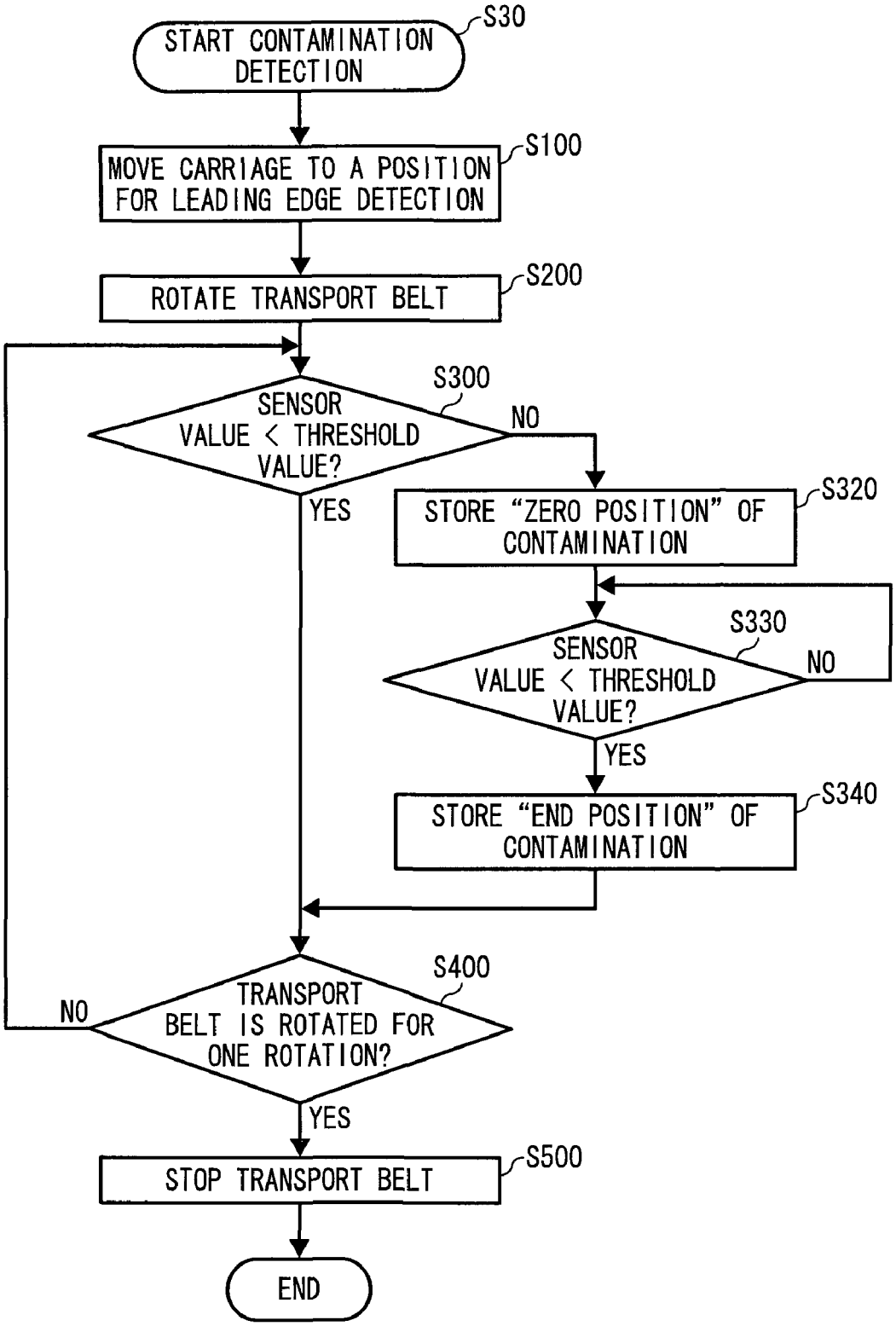

FIG. 9 shows a flow chart for such "contamination check process" including a detection step of "start position" and "last position" of a contaminated area. In such process, if contamination is detected at step 300, a "zero position" of the contamination is stored at step 320, and an "end position" of the contamination is stored at step 340.

If a plurality of contaminated areas exists on the transport belt 4, each of contaminated area data may be stored in a plurality of memory areas provided for the non-volatile memory 11.

In such process shown in FIG. 9, the control system may routinely monitor positions of contaminated areas on the transport belt 4 while driving the transport belt 4. The control system may monitor positions of contaminated areas by detecting contaminated areas by the reflection sensor 1*a* and converting such detected positions as relative position from the reflection sensor 1*a*, or monitor positions of contaminated areas on the transport belt 4 as absolute coordinate system, wherein in absolute coordinate system, an original position used for detecting positions of contaminated areas may be set when a power is supplied to an image forming apparatus, for example, and a positions of contaminated areas from the zero position may be measured using information obtained by the encoder 15.

A description is now given to a case that the control system stops a transportation of the recording medium 7 just before the recording medium 7 is fed to the transport belt 4 if a leading edge of the recording medium 7 may overlap a contaminated area on the transport belt 4 when the recording medium 7 is fed to the transport belt 4. In such a case, after driving the transport belt 4 for a given distance, the control system feeds the recording medium 7 onto the transport belt 4 so that the contaminated area is effectively distanced or separated from a leading edge of the recording medium 7.

However, if such feed timing control is conducted, printing productivity of an image forming apparatus may degrade because a transportation of the recording medium 7 is temporarily stopped.

In view of such situation, another sensor (not shown) may be disposed at an upstream side of a transport direction of the recording medium 7. If a user sets a priority for printing productivity, a leading edge of the recording medium 7 can be detected by such another sensor, instead of using the reflection sensor 1*a*, by which a leading edge position of the recording medium 7 can be detected based on a traveling distance of the transport belt 4.

Figure 10:
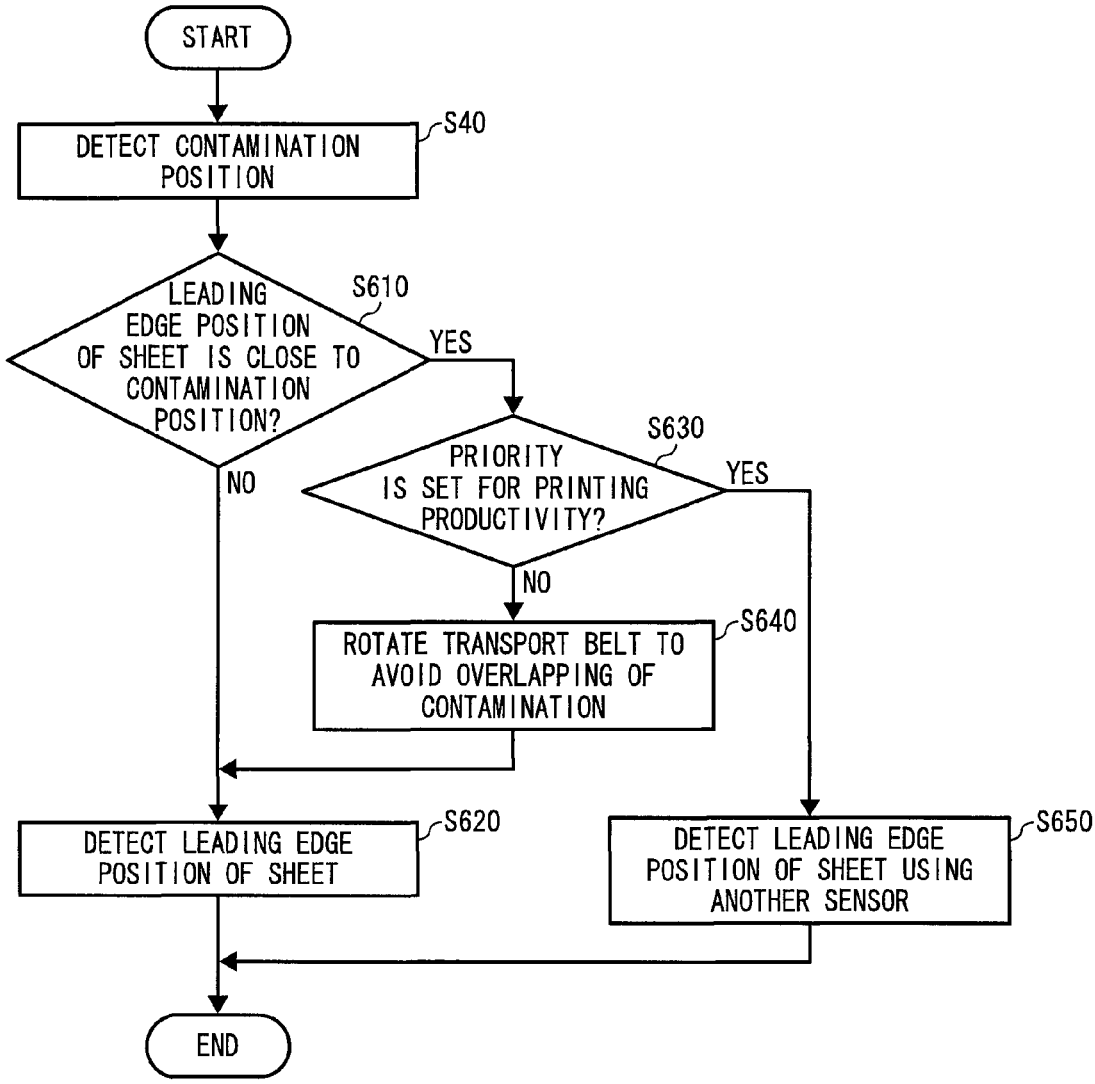

FIG. 10 shows a flow chart for such "contamination check process" including a detection step of a leading edge position of the recording medium 7 using another sensor.

If it is detected that a contamination position is close to the recording medium 7 at step S610, a user can select a priority for an image forming operation at step S630. If a user does not set a priority for printing productivity (No at step S630), the control system temporarily stops the recording medium 7 and rotates the transport belt 4 for a given distance so that a leading edge of the recording medium 7 does not overlap a contaminated area on the transport belt 4 at step S640. Because such process stopping the recording medium 7 may degrade printing productivity, a belt cleaning operation may be preferably conducted for the transport belt 4 after completing a print job if such process stopping the recording medium 7 is conducted.

A cleaning unit, not shown, may automatically conduct such belt cleaning operation. If an image forming apparatus is not provided with a cleaning unit, the control system may inform degradation of printing productivity to a user, and request the user to clean the transport belt 4. The cleaning unit may be devised with known cleaning units.

Although the position of contaminated area can be stored in the non-volatile memory 11 as above described, such contaminated area position may be deviated from the detected position by some reasons. For example, if the image forming apparatus has a configuration that a user can touch the transport belt 4, a user may rotate the transport belt 4 incidentally.

If the transport belt 4 is moved by such reasons, position data of detected contaminated area may not be used effectively because a position of the contaminated area on the transport belt 4 may deviate from the detected position and the control system cannot recognize a deviated position of contamination.

In view of such situation, the control system may store data that a contamination is detected on the transport belt 4 in the non-volatile memory 11 without storing a positional data of contamination. Hereinafter, such data is referred as "positive identification of contamination." Data of "positive identification of contamination" includes information that contamination, causing a missed detection of the leading edge of the recording medium 7, exists on the transport belt 4, but not includes positional information of contamination. The control system may store such data when contamination is detected.

Figure 11A:
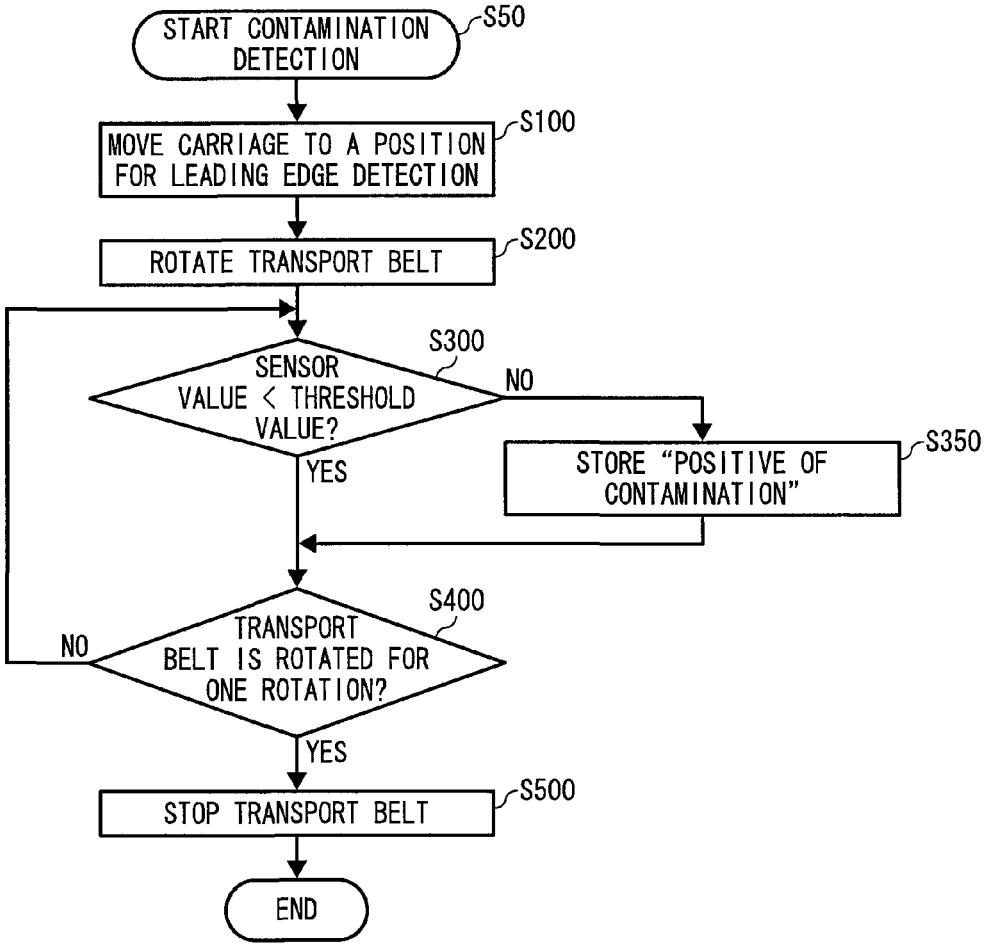
Figure 11B:
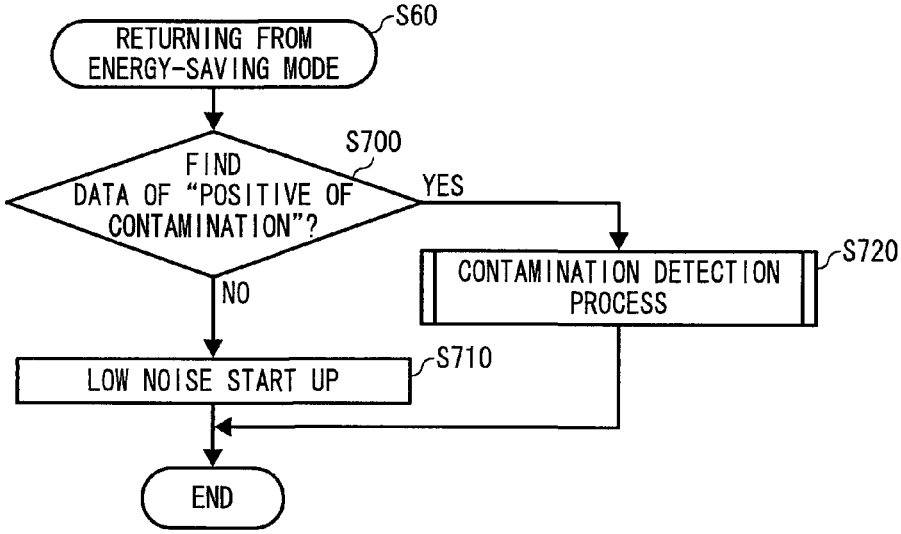

Such data may be used when an image forming apparatus returns from an energy-saving mode (e.g., standby mode), for example. FIGS. 11A and 11B show flow charts for "contamination check process" including using data of "positive identification of contamination" and returning from an energy-saving mode (e.g., standby mode).

As shown in FIG. 11A, if a contamination is detected at step 300, data of "positive identification of contamination" is stored at step 350. Then, as shown in FIG. 11B, when an image forming apparatus returns from an energy-saving mode (e.g., standby mode), the control system checks data stored in the non-volatile memory 11 at step S700. If the control system finds data of "positive identification of contamination" (Yes at S700), the aforementioned contamination check process shown in FIG. 9 may be conducted at step S720, in which the control system moves the carriage 1 in a given position and rotates the transport belt 4 for one rotation to identify a position of contaminated area.

If the control system does not find data of "positive identification of contamination" (No at step S700), the image forming apparatus can be re-started with low noise mode at step S710 because devices or units relevant for contamination check process are not moved. In such low noise mode, a user can perform printing without waiting for some time after returning from the energy-saving mode (e.g., standby mode) because the contamination check process can be omitted, by which a waiting time for user can be preferably reduced.

Although the above described belt cleaning operation can be automatically conducted by the cleaning unit or by manual mode by a user when the control system detects contamination causing the aforementioned missed detection on the transport belt 4, such belt cleaning operation alone may not be effective for removing contamination from the transport belt 4 in some cases.

Figure 12:
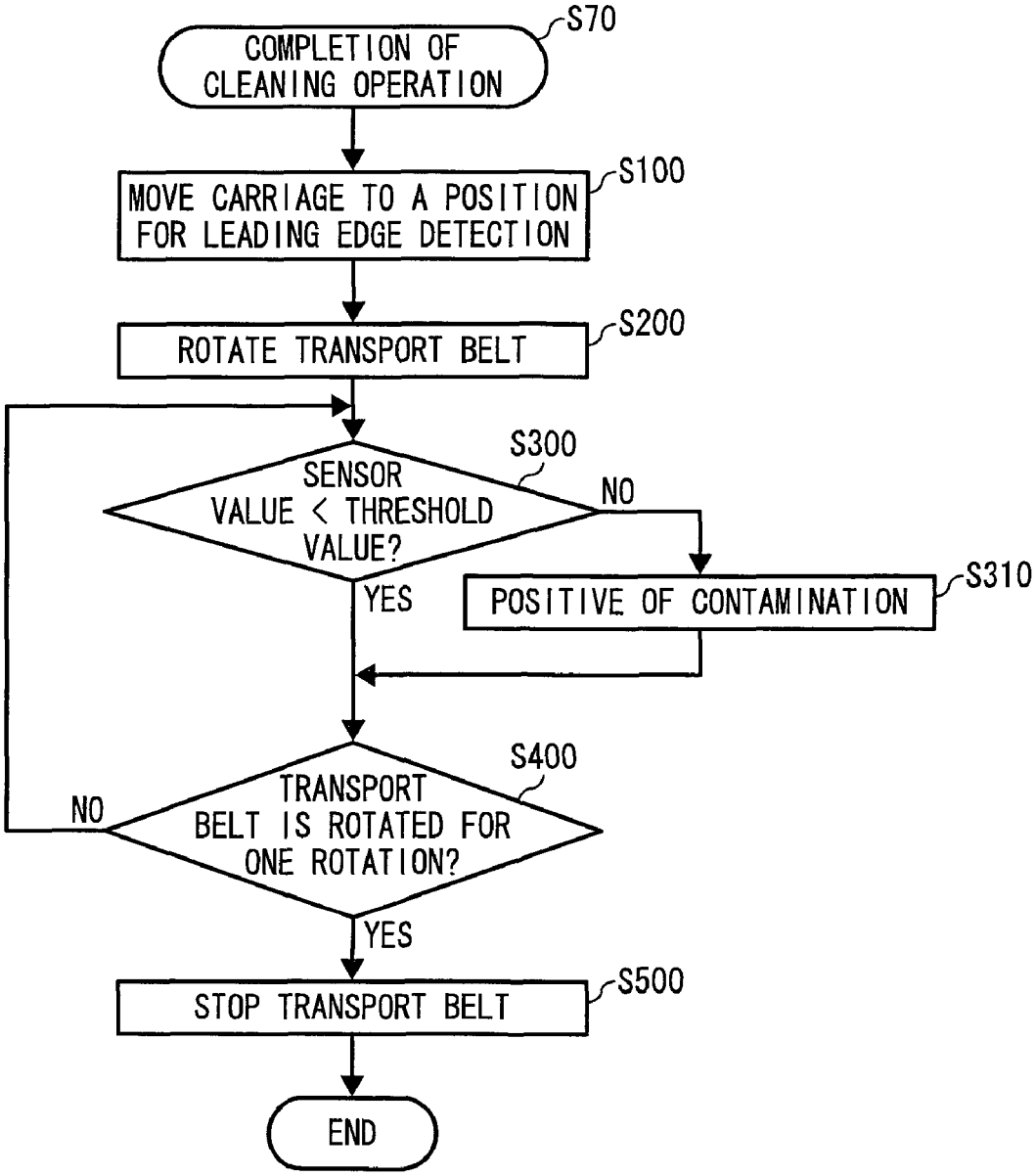

Therefore, when an automatic cleaning operation has completed or when a user closes the cover after completing a manual cleaning operation, the control system may move the carriage 1 to a given position, and drives the transport belt 4 to check an existence or nonexistence of contamination on the transport belt 4. FIG. 12 shows a flow chart for such "contamination check process" conducted after a cleaning operation.

If contamination is not detected by "contamination check process" shown in FIG. 12 while rotating the transport belt 4 for one rotation, the control system determines that a cleaning operation of the transport belt 4 is effectively conducted.

Figure 13:
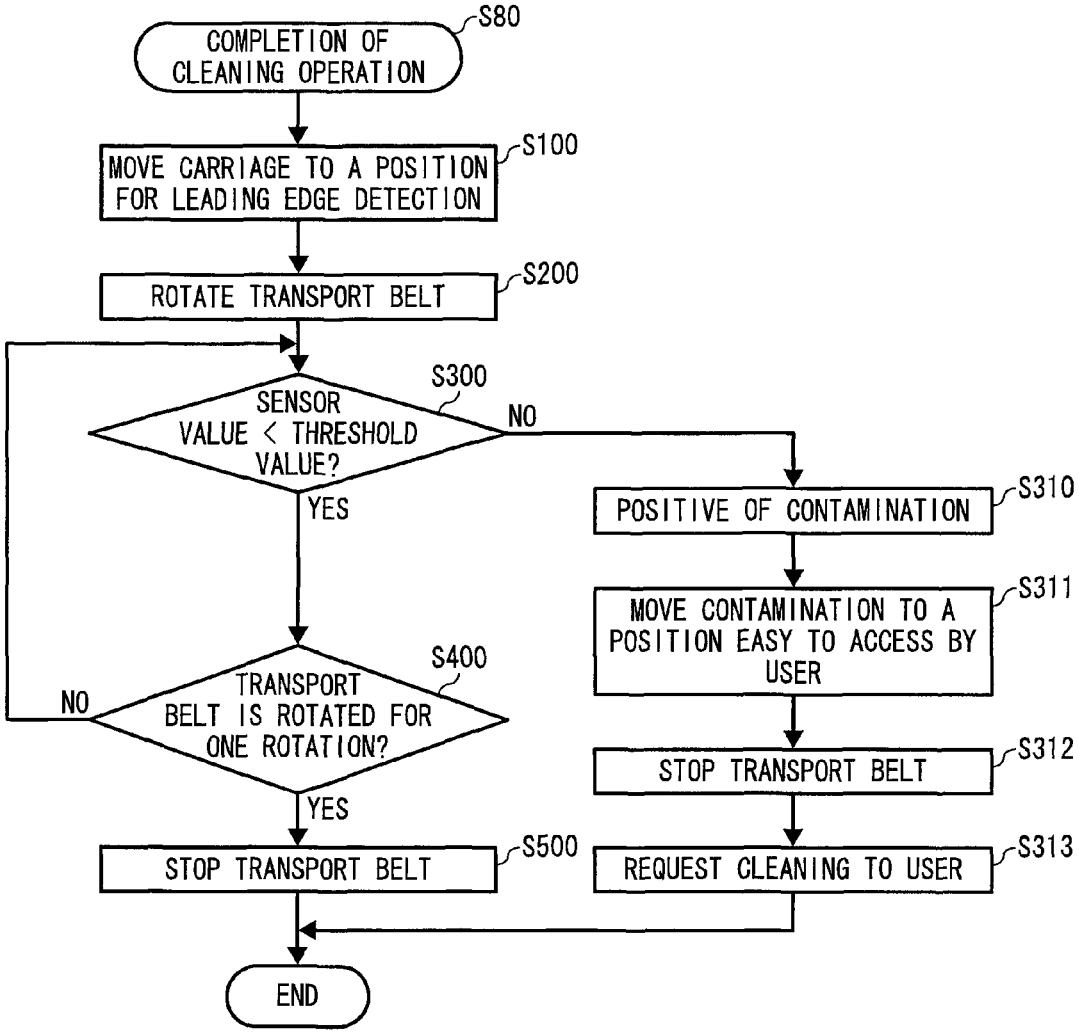

However, if the control system detects contamination at steps S300 and S310 in "contamination check process" shown in FIG. 12, another process shown in FIG. 13 may be conducted. FIG. 13 shows a flow chart for "contamination check process" including a step for requesting a cleaning operation to a user.

When the control system detects contamination at steps S300 and S310 in FIG. 13, the control system stops driving of the transport belt 4 at a given timing so that a position of the contamination comes to a position facing a cover of the image forming apparatus at steps S311 and 312 in FIG. 13, and the control system informs a user using an alarm function when the transport belt 4 stops and requests the user to clean the contamination on the transport belt 4 at step S313. With such process, the user can access to the transport belt 4 and remove the contamination easily. When the user closes the cover after completing a cleaning operation, the control system may re-start a driving of the transport belt 4. The control system may repeats such "contamination check process" until the control system does not detect contamination causing problem for the leading edge detection of the recording medium 7 any more.

As above described, when a power is set to ON to an image forming apparatus (or when an image forming apparatus is activated, contamination on the transport belt 4 causing problem for the leading edge detection of the recording medium 7 can be detected with configurations according to the above-described exemplary embodiments. Further, contamination occurred on the transport belt 4 after activating an image forming apparatus can be detected with configurations according to the above-described exemplary embodiments. Further, by using a priority mode for printing productivity, an image forming operation can be performed with a good level of printing productivity even when contamination exists on the transport belt 4 with configurations according to the above-described exemplary embodiments. Further, if the control system detects that printing productivity is degraded by contamination on the transport belt 4, the control system requests a user to clean the transport belt 4, or the control system activates an automatic cleaning function if an automatic cleaning unit for cleaning the transport belt 4 is provided.

Further, when returning from energy-saving mode (e.g., standby mode), the contamination check process is activated only when the transport belt 4 has contamination thereon before entering the energy-saving mode. If the transport belt 4 has no contamination thereon before entering the energy-saving mode, the control system can omit the contamination check process after returning from the energy-saving mode.

Further, the control system can check a cleaning operation result, and if the control system detects contamination on the transport belt 4 after a cleaning operation, the control system can move a position of contaminated area at a position accessible by a user, by which the transport belt 4 can be effectively cleaned by the user.

As above described, by storing a position of contaminated area on the transport belt 4 in a memory, the control system can recognize contaminated area position at any given timing. With such configuration, the control system can control a sheet feed timing to the transport belt 4 so that a sheet may not overlap on contaminated area. Further, the aforementioned contamination check process may need to be conducted one time before conducting a printing operation (e.g., when a power is supplied to an image forming apparatus, or an image forming apparatus is activated after energy saving mode), by which the number of times for contamination check process can be reduced compared to a conventional image forming apparatus checking contamination on a transport belt for each sheet.

With such configured image forming apparatus, an image forming efficiency can be enhanced overall while effectively detecting contamination on a transport belt, which may cause a missed detection of a leading edge of recording sheet.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

a transport belt configured to transport a recording sheet in a sub-scanning direction;

a carriage for mounting a recording head, the carriage configured to be reciprocally moved in a main scanning direction to record an image on the recording sheet;

a reflection sensor mounted on the carriage, the reflection sensor configured to receive light reflected from the transport belt to detect a leading edge of the recording sheet and output a detection signal corresponding to the received light; and a control unit, the control unit configured to control a contamination check process in which, when the image forming apparatus is activated and before transporting the recording sheet to the transport belt, the control unit instructs the carriage to move to a given position over the transport belt and to drive the transport belt for one rotation while maintaining the carriage at the given position and determines whether contamination exists on the transport belt based on the detection signal output from the reflection sensor; and a position detector configured to detect a drive position of the transport belt and to detect a position of contamination on the transport belt when contamination on the transport belt is detected.

2. The image forming apparatus according to claim 1, further comprising:

an openable cover configured to cover the image forming apparatus; and a cover sensor configured to detect opening and closing of the openable cover, wherein the control unit conducts the contamination check process when the cover sensor detects closing of the openable cover.

3. The image forming apparatus according to claim 1, further comprising:

a non-volatile memory configured to store information indicative of the drive position of the transport belt when contamination is detected as data of the position of contamination on the transport belt.

4. The image forming apparatus according to claim 3, wherein the data of the position of contamination corresponds to a contaminated area detected by the reflection sensor.

5. The image forming apparatus according to claim 3, wherein the position detector is an encoder.

6. The image forming apparatus according to claim 3, wherein the control unit conducts the contamination check process when the control unit finds positive contamination data in the non-volatile memory.

7. The image forming apparatus according to claim 3, wherein the control unit selects a low noise mode as a start-up mode for the image forming apparatus when the control unit does not find positive contamination data in the non-volatile memory when the image forming apparatus is activated.

8. The image forming apparatus according to claim 1, wherein, after the control unit conducts the contamination check process and detects contamination on the transport belt, the control unit drives the transport belt for a given distance to separate the position of contamination from a sheet to be transported on the transport belt, and does not drive the transport belt when a priority is set for a printing productivity.

9. The image forming apparatus according to claim 1, further comprising a cleaning unit configured to conduct a cleaning operation for cleaning the transport belt, wherein the control unit initiates the contamination check process after completing the cleaning operation to check cleanliness of the transport belt.

10. The image forming apparatus according to claim 9, wherein the control unit drives the transport belt to set a contaminated area to a portion accessible by a user when the control unit detects contamination during the contamination check process conducted after completing the cleaning operation.

11. A method of checking for contamination on a transport belt, comprising:

setting a sensor to a given position over the transport belt to detect light reflected from the transport belt;

rotating the transport belt in a given direction for one rotation;

comparing an intensity of the light detected by the sensor with a given threshold value; and determining a contamination level on the transport belt based on a result of comparing the intensity of the light detected by the sensor with the given threshold value; and detecting a drive position of the transport belt and a position of contamination on the transport belt when contamination on the transport belt is detected.

12. The method of claim 11, further including providing information regarding the drive position of the transport belt when contamination on the transport belt is detected.

13. The method of claim 12, further comprising storing said information in memory.

14. The method of claim 13, further comprising storing said information in non-volatile memory.

* * * * *